United States Patent [19]

Johnson

[11] 4,256,122

[45] Mar. 17, 1981

[54] CIGARETTE FILTER

[75] Inventor: Robert R. Johnson, Louisville, Ky.

[73] Assignee: Brown & Williamson Tobacco Corporation, Louisville, Ky.

[21] Appl. No.: 29,230

[22] Filed: Apr. 11, 1979

[51] Int. Cl.[3] ..... A24D 3/04

[52] U.S. Cl. ..... 131/10 A

[58] Field of Search ..... 131/10.5, 10.7, 10 A, 131/261 R, 261 B

[56] References Cited

U.S. PATENT DOCUMENTS

| | | | |
|---|---|---|---|
| 3,773,883 | 11/1973 | Labbe et al. | 131/10.5 |
| 3,910,288 | 10/1975 | Hammersmith et al. | 131/10.5 |
| 3,958,579 | 5/1976 | Baker | 313/10.5 |
| 4,022,221 | 5/1977 | Berger | 131/10.5 |
| 4,082,098 | 4/1978 | Owens | 131/10 A |
| 4,135,523 | 1/1979 | Luke et al. | 131/10.5 |

*Primary Examiner*—Vincent Millin

*Attorney, Agent, or Firm*—Charles G. Lamb; William J. Mason

[57] ABSTRACT

A filter for a cigarette includes a porour filter rod circumscribed by a non-porous or smoke impervious wrapper wherein the filter rod with the non-porous wrapper therearound is provided with grooves extending from one end thereof a preselected distance longitudinally therealong. Tipping material circumscribes the non-porous wrapper and is provided with flow-through openings therein in flow communication with the grooves. The grooves may be oriented to extend to the mouth end of the filter when connected to a cigarette, to the tobacco end of the filter when connected to the cigarette, or non-connecting grooves which extend from each end of the filter element a preselected distance therealong.

9 Claims, 6 Drawing Figures

CIGARETTE FILTER

BACKGROUND OF THE INVENTION

1. Field of the Invention

This invention relates to filters for cigarettes. In one aspect it relates to a filter with novel ventilating means therein. In another respect the invention relates to a filter cigarette having flow directing grooves therein for directing ventilating air either to the tobacco end of the filter or to the mouth end of the filter or a combination thereof.

2. Description of the Prior Art

It is well known in the art to add filters to cigarettes wherein the filters are provided with ventilating means to bring in ambient air into the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough thereby diluting the smoke in the stream. Also, the cigarette wrapper may be perforated at selected locations along the length of the cigarette which provides ports for the cigarette through which ventilating air enters. Even further, it is known to perforate the wrapper of the filter on the filter end of the cigarette to allow for ventilating air to enter the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smokers mouth. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; West German Pat. No. 2,302,677; British Pat. No. 1,414,745; British Pat. No. 1,360,612; British Pat. No. 1,360,611; and, U.S. Pat. No. 3,910,288, the aforementioned British patents being directed to non-wrapped acetate filters.

SUMMARY OF THE INVENTION

The present invention advantageously provides a straight forward arrangement of a filter for a cigarette which in one form achieves normal cigarette pressure drop with low to moderate efficiency filters. The present invention further provides a cigarette filter for lowering tar predominantly by ventilation instead of filtration. The present invention even further provides a filter ventilation system for a cigarette utilizing grooves in the filter plug extending from tipping perforations in the tipping paper to one end of the filter. The present invention also provides a grooved filter with a non-porous or smoke impervious plug wrap.

Various other features of the present invention will become obvious to those skilled in the art upon reading the disclosure set forth hereinafter.

More particularly, the present invention provides a filter for a cigarette comprising a porous filter rod of cylindrical configuration; a non-porous wrapper extending longitudinally of and circumscribing the rod leaving flow-through opposed ends of the rod, the wrapper and rod having a plurality of longitudinally extending grooves circumferentially spaced therearound, the grooves extending from at least one end a preselected distance therealong; and, tipping material extending longitudinally of and circumscribing the wrapper, the tipping material including flow-through openings therein in flow communication with the grooves.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
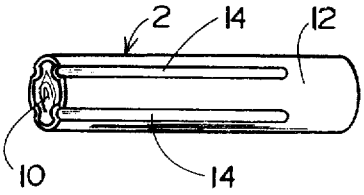
FIG. 1 is a perspective view of a preferred filter element and a non-porous plug wrap of the present invention.

In FIG. 1, a filter plug 2 of the present invention is shown. This filter plug 2 comprises a cellulose acetate filter element 10 or any other filter made from fibrous or foamed materials for tobacco smoke which may be known in the art circumscribed by a non-porous wrapper 12. It is realized that in the use of the term "non-porous wrapper", this includes non-porous outer surfaces of foamed material which are integral with the filter element as well as non-porous wrapping material which is not integral with the filter element. The filter plug 2 is provided with a plurality of grooves 14 therein extending longitudinally therealong. The filter plugs 2 are generally prepared by taking a standard filter rod of cellulose acetate or the like, wrapping the rod with a non-porous wrapping material, then subjecting the wrapped filter rod to a mold or other treating means designed for putting appropriate grooves therein. One such method is known as a heat molding technique, which is well known in the art.

Figure 2:
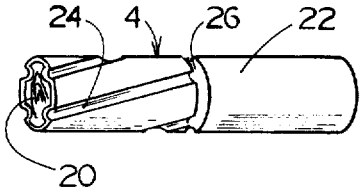
FIG. 2 is a perspective view of another filter element and non-porous plug wrap of the present invention.

FIG. 2 shows another preferred filter plug 4 of the instant invention which is comprised of a cellulose acetate filter element 20 circumscribed by a non-porous plug wrapper 22 with one or more grooves 24 extending from one end of the plug wherein the grooves 24 are disposed at an angle around the filter plug 4. A circumferentially extending groove 26 is also provided to communicate with the grooves 24 wherein the grooves 26 are generally in alignment with tipping perforations as hereinafter described and shown in FIG. 5. In the method of preparing a filter plug 4, the same procedure is utilized as mentioned hereinbefore in discussion of the preparation of filter plugs in FIG. 1.

Figure 3:
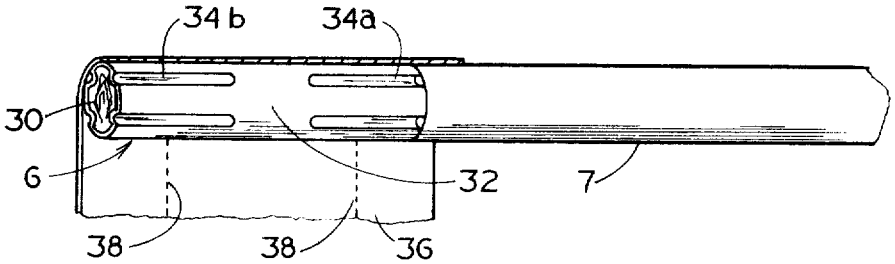
FIG. 3 is a perspective view of even another preferred filter element and non-porous plug wrap of the present invention attached to a cigarette with tipping material shown in an unwrapped condition.

FIG. 3 shows a filter plug 6 which is comprised of a filter element 30 which may be cellulose acetate, or any other filter element known in the art, circumscribed by a non-porous wrapper 32 and includes a plurality of grooves 34*a* and 34*b* extending longitudinally from each end of the plug a peselected distance therealong. In the method of preparing a filter plug 6, the same procedure is utilized as mentioned hereinbefore in discussion of the preparation of filter plugs in FIGS. 1 and 2. However, in use of the filter plug 6 of FIG. 3, by attaching the filter plug 6 to a cigarette or tobacco column 7 and then surrounding the plug by tipping material 36 which includes a pair of parallel rows of ventilating perforations 38, perforations 38 are disposed for alignment with grooves 34*a* and 34*b*. In use, ventilating air travels into the smoker's mouth through grooves 34*b* and travels down the filter plug 6 into the tobacco column 7 through grooves 34*a* simultaneously therewith.

Figure 4:
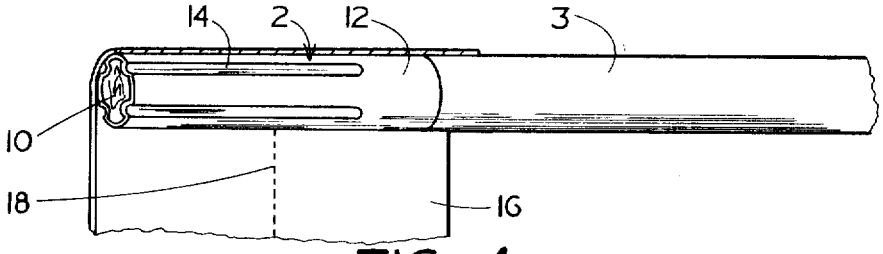
FIG. 4 is a perspective view of the filter element including the non-porous plug wrap of FIG. 1 attached to a cigarette with tipping material shown in an unwrapped condition.

In FIG. 4, a filter plug 2 is attached to a tobacco column or cigarette 3 and is positioned for being wrapped by tipping paper 16 which includes a plurality of perforations 18 therein circumferentially surrounding filter plug 2 and disposed for alignment with the grooves 14 wherein ventilating air radially enters the grooves 14 through the perforations 18. As shown in FIG. 4, ventilating air enters through the tipping perforations 18 traveling down the grooves 14 and toward the smokers mouth.

Figure 5:
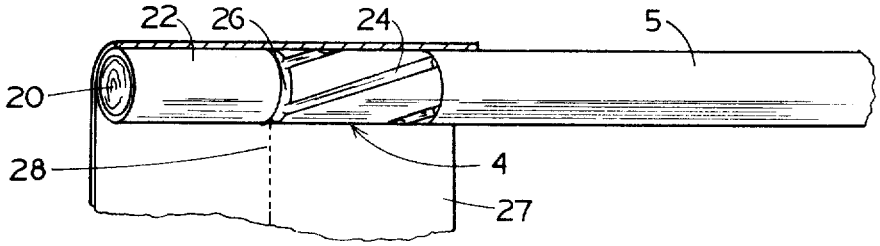
FIG. 5 is a perspective view of a filter element and non-porous plug wrap of FIG. 2 attached to a cigarette wherein the grooves of the filter element are positioned for ventilating air to be directed towards the tobacco column, the tipping material is shown in an unwrapped condition; and, FIG. 6 is a perspective view of another preferred filter element and non-porous plug wrap of the present invention attached to a cigarette with tipping material shown in an unwrapped condition.

In FIG. 5, the filter plug of FIG. 2 is shown attached to a tobacco column or cigarette 5 wherein the grooves 24 are positioned to introduce ventilating air into the tobacco column 5. Tipping paper 27 circumscribes the filter plug 4 and is provided with perforations 28 which are in alignment with the circumferentially extending groove 26 which, in turn, is in flow communication with grooves 24.

Figure 6:
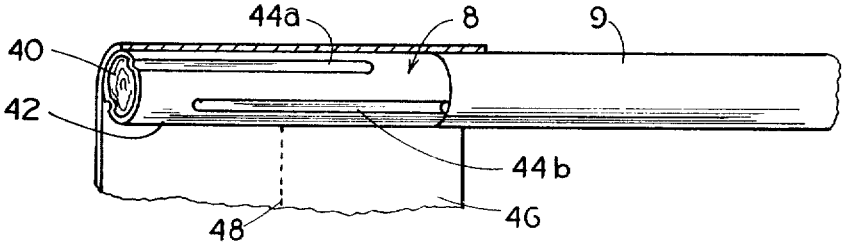

FIG. 6 shows a filter plug 8 which is comprised of a filter element 40 which may be cellulose acetate, or any other filter element known in the art, circumscribed by a non-porous wrapper 42 and includes a plurality of grooves 44*a* and 44*b* extending longitudinally from each end a preselected distance therealong. The method of preparing filter plug 8 is the same procedure as utilized in the preparation of filter plug 2 as discussed hereinbefore. In attaching the filter plug of FIG. 6 to a cigarette or tobacco column 9, the plug 8 and the column 9 are enclosed by tipping material 46 which includes a row of ventilating perforations 48 therein. The perforations 48 are disposed for flow-through communication with the inwardly extending portions of the grooves 44*a* and 44*b* which are in spaced overlapping relation. In use, the ventilating air travels into the smoker's mouth through grooves 44*a* and travels down the filter plug 8 into the tobacco column through grooves 44*b* simultaneously therewith.

It will be realized that various changes may be made to the specific embodiments shown and described without departing from the principles of the present invention.

What is claimed is:

1. A filter for a cigarette comprising:

A porous filter rod of cylindrical configuration;

A smoke impervious wrapper extending longitudinally along said rod from one end thereof and circumscribing said rod leaving flow-through apposed ends of said rod, said wrapper having a plurality of longitudinally extending grooves circumferentially spaced therearound embedded into the filter rod and that portion of the wrapper defining the grooves remaining smoke impervious, said grooves being open ended at and extending from one of said ends a distance less than the length of the filter rod; and, tipping material extending longitudinally of and circumscribing said wrapper, said tipping material being air pervious and permitting ventilating air flow there through into said grooves, said ventilating air being the only fluid flowing through said groove when the filter is used in combination with a cigarette during normal smoke draw.

2. The filter of claim 1 in combination with a cigarette, said grooves of said filter being in flow-communication with said cigarette.

3. The filter of claim 1 in combination with a cigarette, said grooves of said filter being in flow-communication with a smoker's mouth.

4. The filter of claim 1 wherein said tipping material is applied directly to the surface of said wrapper.

5. The filter of claim 1 wherein said tipping is impervious to air, said tipping material having selective perforations therein in flow-communication with said grooves.

6. The filter of claim 1, said grooves being disposed at an angle around said filter rod.

7. The filter of claim 1 including a circumferentially extending groove in flow-communication with said longitudinally extending grooves, said circumferentially extending groove being in alignment with said flow-through opening in said tipping material.

8. The filter of claim 1, said grooves extending from both ends a preselected distance therealong, said grooves being non-connectable.

9. The filter of claim 1, said smoke impervious wrapper being integral with said porous filter rod.

* * * * *